US007915882B2

(12) United States Patent
Hellums

(10) Patent No.: US 7,915,882 B2
(45) Date of Patent: Mar. 29, 2011

(54) START-UP CIRCUIT AND METHOD FOR A SELF-BIASED ZERO-TEMPERATURE-COEFFICIENT CURRENT REFERENCE

(75) Inventor: James R. Hellums, Plano, TX (US)

(73) Assignee: Texas Instruments Incorporated, Dallas, TX (US)

( * ) Notice: Subject to any disclaimer, the term of this patent is extended or adjusted under 35 U.S.C. 154(b) by 220 days.

(21) Appl. No.: 12/199,942

(22) Filed: Aug. 28, 2008

(65) Prior Publication Data

US 2009/0295360 A1 Dec. 3, 2009

Related U.S. Application Data

(60) Provisional application No. 60/972,999, filed on Sep. 17, 2007.

(51) Int. Cl.
*G05F 3/08* (2006.01)
*G05F 3/16* (2006.01)

(52) U.S. Cl. ..... 323/312; 323/313; 323/314; 323/315

(58) Field of Classification Search ..... 323/312, 323/313, 314, 315
See application file for complete search history.

(56) References Cited

U.S. PATENT DOCUMENTS 4,234,841 A * 11/1980 Schade, Jr. ..... 323/268
4,359,680 A * 11/1982 Hellums et al. ..... 323/313

FOREIGN PATENT DOCUMENTS

JP 11102230 A 4/1999
JP 2000148268 A 5/2000
JP 2001344028 A 12/2001

* cited by examiner

*Primary Examiner* — Bao Q Vu
(74) *Attorney, Agent, or Firm* — John J. Patti; Wade J. Brady, III; Frederick J. Telecky, Jr.

(57) ABSTRACT

A current reference circuit is disclosed. A small startup current is defined as the base current into a bipolar transistor with its collector-emitter path connected in series with a resistor between the power supply voltage and ground. This startup current is conducted via a diode-connected MOS transistor in a first leg of a current mirror. Temperature compensation is maintained by a reference leg in the current mirror that includes a bipolar transistor having an emitter area N times larger than that of a bipolar transistor in a second leg of the current mirror, to establish a temperature-compensated current in the reference leg. A compensation capacitor connected between the collector and base of a bipolar transistor in the first leg suppresses oscillation, and can be modest in size due to the Miller effect.

17 Claims, 3 Drawing Sheets

START-UP CIRCUIT AND METHOD FOR A SELF-BIASED ZERO-TEMPERATURE-COEFFICIENT CURRENT REFERENCE

CROSS-REFERENCE TO RELATED APPLICATIONS

This application claims priority, under 35 U.S.C. §119(e), of Provisional Application No. 60/972,999, filed Sep. 17, 2007, incorporated herein by this reference.

STATEMENT REGARDING FEDERALLY SPONSORED RESEARCH OR DEVELOPMENT

Not applicable.

BACKGROUND OF THE INVENTION

This invention is in the field of integrated circuits, and is more specifically directed to circuits for establishing a reference current within integrated circuits.

The operation of a wide variety of modem integrated circuit functions often relies upon a stable reference level within the integrated circuit. Current-mode circuits have become popular in modem high-performance integrated circuits, because of their inherent higher-speed operation relative to voltage-mode circuits. Accordingly, circuits for generating stable reference currents have recently gained in importance.

It is highly desirable that on-chip-generated reference currents be stable over the operating temperature range of the integrated circuit. Temperature-stable reference currents are conventionally produced by so-called "zero TC" (zero temperature coefficient) reference circuits. The operating principle of zero TC reference circuits commonly relies on compensating a voltage or current that has a positive temperature coefficient (proportional-to-absolute-temperature, or "PTAT") with a voltage or current that has a negative temperature coefficient (complementary-to-absolute-temperature, or "CTAT"; also referred to as "inverse PTAT"). For example, a voltage corresponding to the difference between the base-emitter voltages of bipolar transistors that conduct dissimilar collector-emitter current densities is proportional to absolute temperature. This PTAT voltage can be added to a voltage that has a negative temperature coefficient (e.g., the base-emitter voltage of a bipolar transistor) to produce a compensated "zero-TC" output current.

FIG. 1 illustrates a conventional zero temperature-coefficient current reference circuit that operates according to this principle. P-n-p bipolar transistor 5 has its emitter at the $V_{dd}$ power supply voltage, and its base connected to its collector, which is connected to ground ($V_{ss}$) via resistor 10 and the source-drain path of n-channel MOS transistor 8. P-n-p bipolar transistor 7 also has its emitter at $V_{dd}$, and has its collector connected to ground via the source-drain path of n-channel transistor 6. N-channel transistors 6 and 8 conduct the same current as one another, as their gates are connected to the gate of diode-connected n-channel transistor 4 in current mirror fashion, and their channel width-to-length ratios (W/L) are equal. Output transistor 2 similarly has its gate connected in this MOS current mirror, and sinks the output reference current $I_{ref}$ at the open-drain output of the circuit. The base of transistor 7 is connected to node B0 at the other side of resistor 10 from the base and collector of transistor 5. In this conventional circuit, the emitter area of transistor 5 is sized to be N times the emitter area of transistor 7. Node B0 is coupled to the $V_{dd}$ power supply via resistor 9, which is matched and ratioed to have a resistance that is M times that of resistor 10. The relative sizes of components in the circuit of FIG. 1 are shown by parentheticals, where relevant.

The drain and gate of MOS transistor 4, connected together in diode fashion, is connected to the collector of p-n-p transistor 3, which has its emitter at the $V_{dd}$ power supply. The base of transistor 3 is connected, at node B2, to the collector of transistor 7 and the drain of transistor 6. Capacitor 11 is connected between node B2 and the $V_{dd}$ power supply, and serves to increase the power supply rejection ratio (i.e., reduce variations in the output current in response to variations in the $V_{dd}$ power supply voltage), and to compensate the positive feedback loop in the circuit, as known in the art.

In its steady-state operation, the voltage at node B2, which is at the collector of transistor 7 and the base of transistor 3, will be equal to the voltage at node B0, which is at the base of transistor 7. This voltage matching occurs because the collector-emitter currents conducted by transistors 3 and 7 are forced equal by the current mirror of matched transistors 4 and 6; because transistors 3 and 7 are also matched in size, their collector-emitter current densities are equal to one another, and thus their base-emitter voltages are equal to one another. The temperature stability of this bias condition results from the current at node B0 being established as the sum of a CTAT current (established by the base-emitter voltage of transistor 7, across resistor 9), and a PTAT current defined by the difference in base-emitter voltages of transistors 5, 7 (resulting from their different current densities) impressed across resistor 10. This stable bias point ensures the temperature stability of output reference current $I_{ref}$, which is the source-drain current of transistor 2.

Error in the operation of the circuit of FIG. 1 is reduced by a factor corresponding to the gain of the amplifier of transistor 3, because of the negative feedback gain loop established by transistors 3, 4, 5, 6, 7, and 8, and resistors 9 and 10. On the other hand, a positive feedback gain loop consisting of transistors 3, 4, 6 and 7 is also present. The circuit is stable so long as the negative feedback loop dominates the positive feedback loop; this condition is assisted by the compensation of the positive feedback loop by capacitor 11. In practice, the circuit of FIG. 1 is typically used in integrated circuits that are constructed by n-well MOS technology, in which case p-n-p bipolar transistors 3, 5, 7 are parasitic devices. The low 0 of these bipolar transistors 3, 5, 7 facilitates stable operation of the circuit, and reduces the size of capacitor 11 that is necessary for adequate compensation.

Modem integrated circuit technology now enables complementary MOS (CMOS) and both bipolar and CMOS devices (BiCMOS) in the same integrated circuit. As a result, current reference circuits that do not rely on parasitic bipolar devices, and that therefore provide higher-precision reference levels, are easily realized. FIG. 2 illustrates a conventional zero-TC current reference circuit realized by p-channel MOS transistors and n-p-n bipolar devices according to this higher capability technology.

In the circuit of FIG. 2, the reference leg includes n-p-n bipolar transistor 15, which has its emitter at $V_{ss}$ and its base and collector connected together. Resistor 16 is connected between this base-collector node and, the drain of p-channel MOS transistor 14, at node X. Transistor 14 has its source at $V_{dd}$, and its gate is connected in common with the gates of p-channel MOS transistors 12, 20, 24, 28, each of which has its source also at $V_{dd}$. Transistor 12 serves as the output device, and sources output current $I_{ref}$ in open-drain fashion. Transistor 28 has its gate connected to its drain, in diode fashion. N-p-n transistor 29 has its collector connected to the gate-drain node of transistor 28, and its emitter at $V_{ss}$. Similarly, n-p-n transistor 21 has its collector connected to the drain of transistor 20, and its emitter at $V_{ss}$; the base of transistor 21 is connected at node X to the drain of transistor 14 and to resistor 16. Resistor 26 is connected between this node X at the base of transistor 21, and ground ($V_{ss}$). The base of transistor 29 is connected to the drain of transistor 20, at node A, and also to the drain of p-channel transistor 22. Resistor 19 is connected between the drain of transistor 24 (and the gate of transistor 22) and $V_{ss}$. Compensation capacitor 27 is connected between node A, at the base of transistor 29, and $V_{ss}$.

Resistors 16, 19, and 26 are typically realized as polysilicon resistors, or alternatively by another resistive material such as thin film or doped silicon. Resistors 16 and 26 are matched and ratioed relative to one another, with resistor 26 having a resistance that is a multiple M times that of resistor 16. For purposes of temperature compensation, as discussed above, transistor 15 has an emitter area that is larger than that of transistors 21, 29 (which are typically matched to one another), by a factor of N.

In its steady-state operation, the conventional circuit of FIG. 2 settles at a bias condition at which the voltage at node A equals the voltage at node X, in this typical situation in which transistors 21, 29 are matched in size. This voltage at nodes A, and X corresponds to the base-emitter voltage of transistors 29 and 21, respectively, because the matched currents conducted by the current mirror of transistors 28 and 20, respectively, ensure equal current densities through transistors 21 and 29. At this bias condition, the current conducted by transistor 28 is mirrored by transistor 14 in the reference leg, and by transistor 12 at the output. As in the case of FIG. 1, because transistor 15 has an emitter area N times that of transistor 21 yet conducting the same current as transistor 21 (by virtue of the mirroring of transistors 14, 20), a positive temperature coefficient base-emitter voltage differential is established across resistor 16. This PTAT current is summed at node X with the CTAT current defined by the base-emitter voltage of transistor 21 that is established across resistor 26. The current at node X in the reference leg thus remains constant over temperature, maintaining the output reference current $I_{ref}$ stable over variations in temperature. In the circuit of FIG. 2, precise operation is facilitated by the amplifier of transistor 29, which establishes a negative feedback loop including transistors 14, 15, 20, 21, 28, and 29, and resistors 16 and 26. On the other hand, a positive feedback loop is established by the loop of transistors 20, 21, 28, and 29. Stability, of course, requires that the negative feedback loop dominate the positive feedback loop in operation.

While the circuit of FIG. 1 typically relied on MOS transistor leakage for startup, the conventional circuit of FIG. 2 includes a positive-feedback startup circuit of transistor 22, in combination with resistor 19 and transistor 24. Prior to startup, no source-drain current is conducted through transistor 28, and thus no mirrored current is conducted by the other MOS devices 20, 24, 12, 14. As the $V_{dd}$ power supply voltage increases from ground ($V_{ss}$), p-channel transistor 22 is turned on because its gate is biased to $V_{ss}$ through resistor 19. As $V_{dd}$ increases to a certain level, transistor 22 provides sufficient base current to transistor 29 to turn it on, which then turns on diode-connected transistor 28. The current through transistor 28 is then mirrored through the other MOS transistors 12, 14, 20, 24. Upon sufficient source-drain current conducted by transistor 24, the gate of transistor 22 will be pulled sufficiently high toward $V_{dd}$, turning off transistor 22 and allowing the circuit to settle at its steady-state bias point.

However, n-p-n transistors 15, 21, 29 in this conventional circuit have relatively high β (e.g., on the order of 125), which results in a significant gain in the positive feedback loop of transistors 20, 21, 28, 29. This high loop gain presents a risk that the increasing collector current of transistor 29 will increase the drain-to-source voltage of transistor 28 and undesirably pull the drain of transistor 28 toward $V_{ss}$, which crashes the collector-emitter voltage of transistor 29 to ground and turns off conduction. The positive feedback startup circuit exacerbates this instability by sensing this state and then turning transistor 22 back on again, which sources base current to transistor 29 that is amplified by its high β, again undesirably increasing the drain-to source voltage of transistor 28. The voltage at node A thus oscillates. While capacitor 27 can theoretically compensate this positive feedback loop to suppress this relaxation oscillation at node A, the size of capacitor 27 required for such compensation is generally too large for efficient implementation in modern integrated circuits. For example, a capacitor 27 of 100 pF (which is approaching the practical limit in modem technology) is inadequate to suppress this relaxation oscillation, in the circuit of FIG. 2 in which transistors 21, 29 have a β of 125. Accordingly, the conventional circuit of FIG. 2 has significant limitations when applied to modern high-performance integrated circuit functions.

As known in the art, current reference circuits that startup from a "constant current" avoid the need to use positive feedback. This is because, in conventional circuits, the constant startup current is injected into only one of the legs of the circuit, thus presenting imbalance in the steady-state bias condition and a corresponding lack of precision in the output reference current. As such, only extremely low levels of constant current can be tolerated in current reference circuits. While JFET devices are ideal for conducting constant low level currents, it is generally too expensive to realize JFETs in modern CMOS and BiCMOS manufacturing process flows, because of the additional process steps that would be necessary. While one could reduce the constant current level by way of a very large resistor, the chip area cost required to realize a polysilicon or diffused resistor of sufficient resistance (on the order of one gigohm) to define a sufficiently low constant current is also prohibitive. In addition, DC power consumption is undesirable in integrated circuits, especially for power-conscious circuits that are used in modern battery-powered digital systems ranging from laptop computers to cellular telephone handsets. As such, conventional current reference circuits in modern, low-power, high-performance, integrated circuits rely on positive feedback startup circuits similar to that of FIG. 2, and must tolerate the potential for instability presented by the oscillating node.

BRIEF SUMMARY OF THE INVENTION

It is therefore an object of this invention to provide a current reference circuit and method of generating a reference current with stable startup characteristics.

It is a further object of this invention to provide such a circuit and method in which the level of constant current conducted by the circuit is very small.

It is a further object of this invention to provide such a circuit that can be efficiently realized in high-performance integrated circuits.

It is a further object of this invention to provide such a circuit and method in which compensation components can be kept small and efficiently realizable.

It is a further object of this invention to provide such a circuit and method that provides good startup performance over a wide range of power supply voltage ramp rates.

Other objects and advantages of this invention will be apparent to those of ordinary skill in the art having reference to the following specification together with its drawings.

The present invention may be implemented into a current reference circuit, and method of operating the same, in which a continuous current is fed from the power supply voltage, through a diode-configured transistor in a current mirror, as a base current to a bipolar transistor. As the power supply voltage increases in startup, this continuous current turns on that bipolar transistor, forward-biasing the diode-configured transistor and initiating the current conducted by the current mirror legs. Compensation of the loop gain in the circuit is provided by a small Miller-connected capacitor.

DETAILED DESCRIPTION OF THE INVENTION

The present invention will be described in connection with one of its embodiments, more specifically a current reference circuit realized by way of both bipolar and MOS transistors. However, it is contemplated that this invention may be implemented in connection other reference circuits, and reference circuits constructed to other technologies, while still attaining its benefits. Accordingly, it is to be understood that the following description is provided by way of example only, and is not intended to limit the true scope of this invention as claimed.

Figure 3:
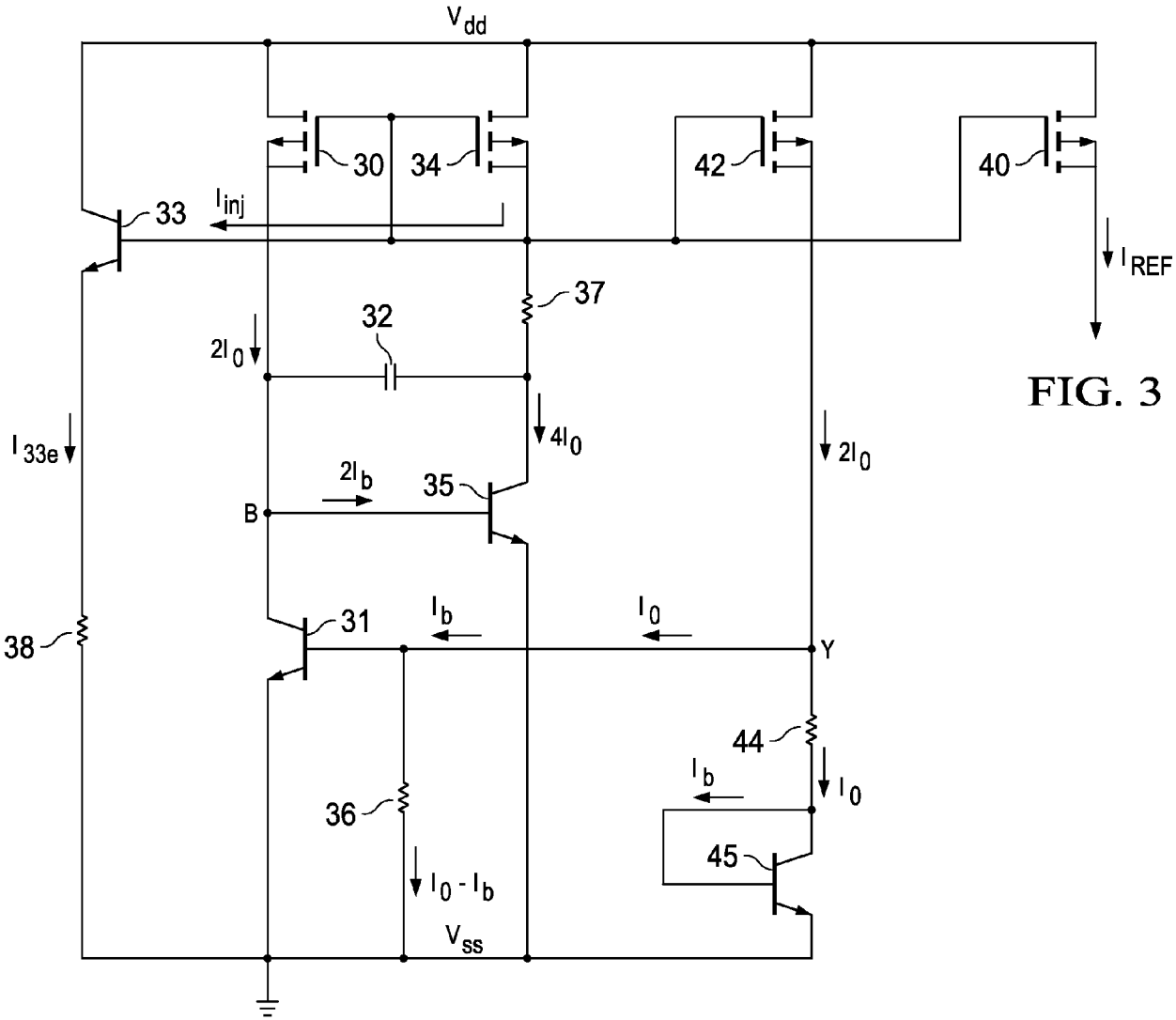
FIG. 3 is an electrical diagram, in schematic form, of a current reference circuit according to the preferred embodiment of the invention.

FIG. 3 illustrates a current reference circuit according to an embodiment of this invention. In this circuit, the temperature-compensated reference leg includes p-channel metal-oxide semiconductor (MOS) transistor 42, which has its source at the $V_{dd}$ power supply voltage and its drain of transistor 42 connected to resistor 44, at node Y. Resistor 44 is connected between this node Y and the collector and base of n-p-n bipolar transistor 45, which has its emitter at ground ($V_{ss}$). The gate of transistor 42 is connected in common with the gate of output p-channel MOS transistor 40, which has its source at $V_{dd}$ and which provides the output current $I_{ref}$ in open-drain fashion. The gates of transistors 40, 42 are connected in current mirror fashion to the gate and drain of diode-connected p-channel MOS transistor 34, which has its source at $V_{dd}$. Another leg of the current mirror is established by p-channel MOS transistor 30, which has its source connected to the $V_{dd}$ power supply and its gate connected in common with the gates of transistors 34, 40, 42.

The gate and drain of transistor 34 are connected via resistor 37 to the collector of n-p-n transistor 35, which has its emitter at $V_{ss}$. The drain of transistor 30 is connected, at node B, to the collector of n-p-n transistor 31, which also has its emitter at ground. The base of transistor 35 is connected to node B, at the drain of transistor 30 and the collector of transistor 31, while the base of transistor 31 is connected to node Y at the drain of transistor 42. Bias resistor 36 is connected between node Y (at the base of transistor 31) and $V_{ss}$. Compensation capacitor 32 is connected between the collector and base of transistor 35, and forms an R-C network with resistor 37 connected between the collector of transistor 35 and the drain of transistor 34. This R-C network compensates the positive feedback gain loop in the circuit, and resistor 37 avoids latchup in the event of a power supply "glitch", as will be described in further detail below.

According to this embodiment of the invention, transistor 34 has a size (i.e., channel width-to-length ratio, or W/L) that is twice that of the other MOS transistors 30, 40, 42. Bipolar transistor 35 has an emitter area that is twice that of transistor 31, and bipolar transistor 45 has an emitter area that is N times larger than the emitter area of transistor 31. Resistor 36 has M times the resistance of resistor 44. The relative sizes of components in the example of the circuit of FIG. 3 are shown parenthetically, where relevant.

Voltages and currents at nodes B and Y are well-balanced in the steady-state operation of the circuit of FIG. 3 according to this embodiment of the invention. As mentioned above, transistor 34 has a W/L ratio twice that of transistor 30 and thus conducts twice the source-drain current of transistor 30 in the current mirror. As a result, transistor 35 conducts twice the collector-emitter current of transistor 31. Because the emitter area of transistor 35 is twice that of transistor 31, the current densities at transistors 31, 35 are equal to one another, and therefore their base-emitter voltages (at nodes Y, B, respectively) equal one another in the steady-state. Also at steady-state, the currents in the circuit are well-balanced due to the relative sizes of transistors 30, 34, 42. As shown in FIG. 3, the current conducted by equally-sized current mirror transistors 30 and 42 is $2I_0$, and transistors 31 and 45 each have a base current $I_b$ supporting their collector currents. Because transistor 34 has a W/L ratio twice that of transistors 30 and 42, its source-drain current is $4I_0$, and the base current of transistor 35 is $2I_b$ (i.e., twice the base current $I_b$ of transistors 31, 45). The currents are thus well-balanced at nodes B and Y in the circuit of FIG. 3, considering that the collector currents of their respective transistors 31 and 45 are at a ratio of 2:1, considering the splitting of the current at node Y (i.e., the current $I_0$ into the branch of resistor 36 and the base of transistor 31, and the current $I_0$ into the branch of resistor 44 and transistor 45, including the base current into transistor 45 itself).

According to this embodiment of the invention, the source-drain current conducted by transistor 42 at steady-state is temperature-compensated. As mentioned above, transistor 31 conducts twice the collector current as transistor 45. Because transistor 45 has an emitter area N times that of transistor 31, the current densities at transistors 31 and 45 differ from one another by the factor 2N, giving rise to a corresponding difference in their base-emitter voltages. This voltage difference has a positive temperature coefficient (PTAT), as discussed above, and appears across resistor 44. Conversely, the base-emitter voltage of transistor 31 itself, reflected across resistor 36, has a negative temperature coefficient (CTAT). Accordingly, any change in the current drawn by resistor 44 (due to changes in its PTAT voltage) is compensated by a corresponding change of opposite polarity in the current drawn by resistor 36 (due to changes in its CTAT voltage). The sum of these currents, conducted by transistor 42, is therefore temperature compensated by the complementary temperature coefficients. As a result, the output current sourced by output transistor 40 is stable over temperature.

Figure 1:
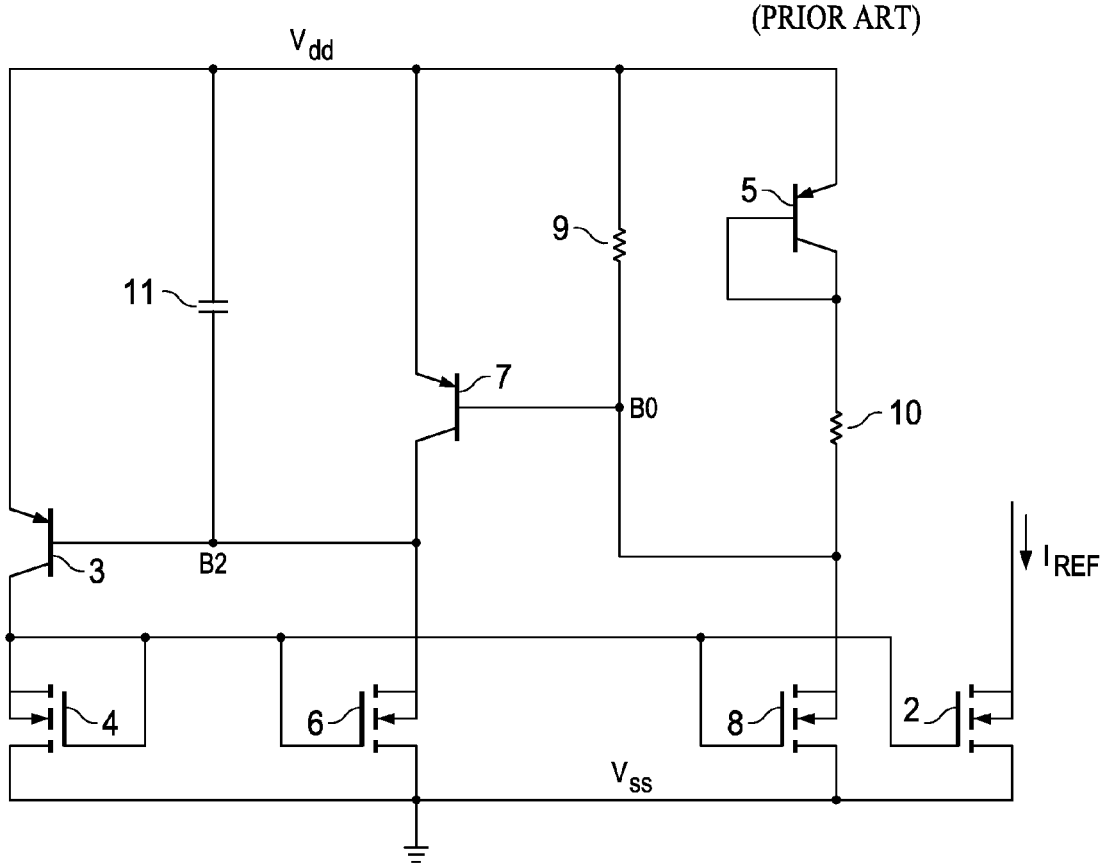
FIG. 1 (PRIOR ART)
FIG. 1 is an electrical diagram, in schematic form, of a conventional current reference circuit.
Figure 2:
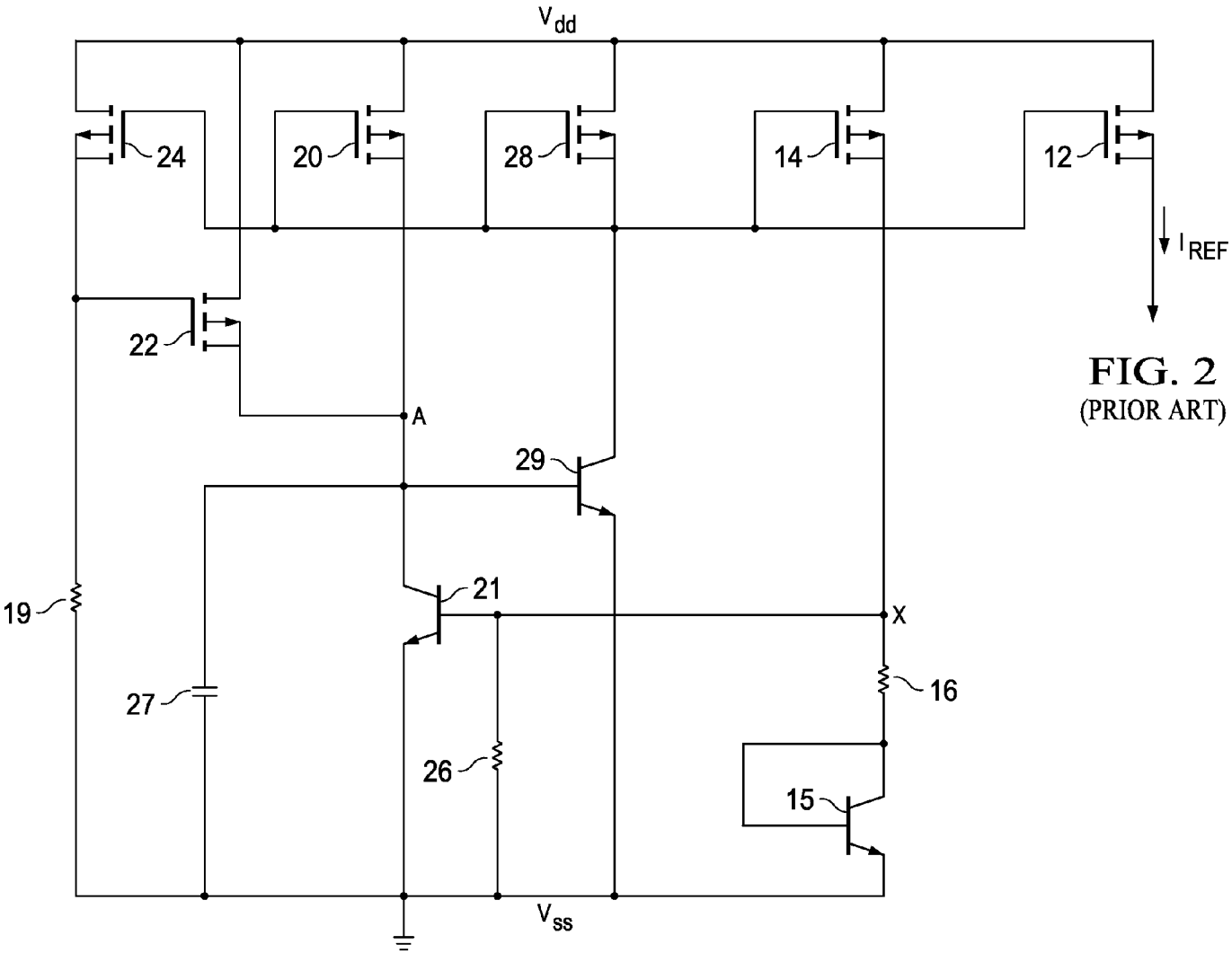
FIG. 2 (PRIOR ART)
FIG. 2 is an electrical diagram, in schematic form, of another conventional current reference circuit.

Startup of the current reference circuit according to this embodiment of the invention is effected by transistor 33 and resistor 38. Prior to startup, of course, all nodes are either at ground or floating, depending on the initial state of the device. Transistor 33 is initially in an off-state, with its emitter at $V_{ss}$ by virtue of resistor 38 (which is initially conducting no current). As startup begins with the $V_{dd}$ power supply voltage ramping up, the collector voltage of transistor 33 follows the $V_{dd}$ power supply voltage as it increases from ground toward its eventual level (e.g., between 1.5 volts and 5.5 volts, as desired by the system and its designer) relative to $V_{ss}$. Upon reaching the situation:

$$V_{dd}-V_{ss}>|V_{th34}|+V_{be33}$$

where $V_{th34}$ is the threshold voltage of transistor 34 and where $V_{be33}$ is the base-emitter voltage of transistor 33, diode-connected transistor 34 turns on and begins conducting source-drain current. A part of this source-drain current serves as injection current $I_{inj}$ into the base of transistor 33. At this point, the $V_{dd}$ power supply voltage is sufficiently biasing the collector of transistor 33 relative to its emitter, so that the base current $I_{inj}$ supplied through transistor 34 (even at a relatively low current level) causes transistor 33 to conduct substantial collector-emitter current $I_{33e}$. To a first order of analysis, this emitter current $I_{33e}$ is determined by the $V_{dd}$ power supply voltage and the resistance of resistor 38. It has been observed that the startup performance of this circuit is not very sensitive to this resistance value of resistor 38; this insensitivity is in stark contrast with the conventional circuit described above relative to FIG. 2, in which the startup performance is very sensitive to the resistance value of resistor 19.

Once transistor 33 is turned on in the circuit of FIG. 3, it will demand additional base current to be conducted from transistor 34. The base current demanded by transistor 33 is thus the emitter current $I_{33e}$ (determined by the $V_{dd}$ power supply voltage and the resistance of resistor 38), divided by the β of transistor 33, which is typically contemplated to be on the order of 100 to 125. This startup current into the base of transistor 33 is supplied by transistor 34, and the source-drain current conducted by transistor 34 is mirrored as source-drain current through transistors 30 and 42. The currents conducted by transistors 30, 34, and 42 turn on transistors 31, 35, and 45. Upon transistors 31, 35, and 45 turning on, the current reference circuit of FIG. 3, according to this embodiment of the invention, rapidly settles to its steady-state operating point at which the voltage at node B will equal the voltage at node Y, as described above.

It has been observed that the circuit of FIG. 3 reliably starts up and rapidly settles to a stable equilibrium operating point, over a wide range of $V_{dd}$ power supply voltages (e.g., from 1.5 volts to 5.5 volts), and over a wide range of ramp rates. The reference current $I_{ref}$ has been observed to be stable over a wide temperature range, exceeding that of typical commercial specifications for modern integrated circuits.

As noted above, the startup current conducted by transistor 34 is the base current into transistor 33. As evident from the circuit diagram of FIG. 3, this base current is conducted continuously so long as the $V_{dd}$ power supply voltage is active. However, this base current $I_{inj}$ is a very small current because it is limited to the emitter current $I_{33e}$ of transistor 33, divided by the β of transistor 33. And because the emitter current $I_{33e}$ can be kept relatively small by selecting a relatively large resistor 38, the base current $I_{inj}$ can be extremely small. In one implementation of the embodiment of the invention shown in FIG. 3 in which the desired output reference current $I_{ref}$ is about 2.5 μA, this base current $I_{inj}$ can range from 1 nA to about 7.5 nA, for power supply voltage $V_{dd}$ ranging from 1.7 volts to 5.0 volts. The potential circuit imbalance due to such a small startup current is negligible, even though the startup current is conducted continuously during operation of the circuit. Indeed, because this startup current $I_{inj}$ is part of the current conducted by transistor 34 that is also mirrored through transistors 30 and 42, the continuous startup current $I_{inj}$ appears in all three circuit legs, and thus does not imbalance the circuit.

According to this embodiment of the invention, a modestly-sized capacitor 32 can easily compensate circuit operation to suppress oscillation. As evident from FIG. 3 and the foregoing description, the startup current $I_{inj}$ from transistor 34 into the base of transistor 33 is effectively a continuous or constant current, and will continue to conduct during operation. A positive feedback configuration is therefore not used by the circuit of FIG. 3 for startup, which removes a significant source of potential oscillation from the circuit, especially as compared with conventional circuits such as that discussed above relative to FIG. 2. The extent of compensation necessary from compensation capacitor 32 is thus reduced for this circuit as compared with conventional circuits. Secondly, compensation capacitor 32 in this embodiment of the invention is connected between the collector and base nodes of transistor 35, which as described above is a double-sized device (relative to transistor 31). Because of this base-collector coupling, the effect of capacitor 32 on the response of transistor 35 is boosted by the well-known Miller effect, which increases the input capacitance presented by capacitor 32 by a factor related to the loop gain. In the circuit of FIG. 3, the negative feedback gain loop includes the amplifier of transistors 30, 31, 34, and 35 and resistor 36, and the reference leg of transistors 42 and 45 and resistor 44; on the other hand, the positive feedback gain loop includes the amplifier of transistors 30, 31 with transistors 34, 35. For the example in which a 100 pF capacitance connected between node B and $V_{ss}$ would be sufficient to compensate the positive feedback gain loop and suppress oscillation in this circuit, because of the Miller effect, Miller-coupled compensation capacitor 32 in the circuit of this embodiment of the invention need only be of a size of about 7.5 pF to adequately compensate the positive feedback loop. According to this embodiment of the invention, therefore, good suppression of oscillation by compensation capacitor 32 can be attained at a very modest cost in chip area.

Resistor 37, in the circuit of FIG. 3 according to this embodiment of the invention, is provided to protect against "glitches", or sudden excursions, of the $V_{dd}$ power supply. In the event of a rapid drop in the $V_{dd}$ power supply voltage, the voltage across capacitor 32 of course cannot change instantaneously and thus the voltage at node B would absorb the sudden voltage drop. If node B were to drop below $V_{ss}$, transistor 31 could "latch-up" into a state that would prevent proper subsequent operation of the circuit. Resistor 37 keeps node B from rapidly dropping below $V_{ss}$ in this event, by absorbing some of this transient voltage swing, because the current into capacitor 32 necessarily must pass through resistor 37 and cause a voltage drop. Again, the resistance value of resistor 37 is not particularly critical; it is contemplated that those skilled in the art having reference to this specification will be readily able to implement the circuit of this embodiment of the invention without undue experimentation, including in the selection of the particular component values and device sizes.

According to this embodiment of the invention, therefore, a reference current that is stable over temperature is produced by a circuit that is compatible with modern high-performance manufacturing technology. This circuit provides exceptional suppression of oscillation upon startup, and robust startup performance, by avoiding the need for a strong positive feedback startup loop. The constant, or continuous, current required for startup is extremely small, as that current is a base current into a bipolar transistor and is thus reduced by the β of that transistor; in addition, this constant base current is applied to complementary balanced legs in the circuit, and therefore does not disturb the stability of the circuit. Loop compensation is efficiently attained by Miller-coupling of a compensation capacitor, and latchup is also prevented by virtue of the construction of this circuit. It is therefore contemplated that the current reference circuit and method of operating such a circuit according to this invention provides important advantages to modern integrated circuits.

While the present invention has been described according to its preferred embodiments, it is of course contemplated that modifications of, and alternatives to, these embodiments, such modifications and alternatives obtaining the advantages and benefits of this invention, will be apparent to those of ordinary skill in the art having reference to this specification and its drawings. For example, this invention may also be used, and will be beneficial, in current reference circuits that are not "zero-TC" references. It is contemplated that such modifications and alternatives are within the scope of this invention as subsequently claimed herein.

What is claimed is:

1. A current reference circuit comprising:

a current mirror first leg including:

a first MOS transistor, having a gate connected to a drain, and having a source coupled to a first reference voltage; and a first bipolar transistor, having a collector coupled to the drain and gate of the first MOS transistor, having a base, and having an emitter connected to a second reference voltage;

a current mirror second leg including:

a second MOS transistor, having a gate coupled to the gate and drain of the first MOS transistor, having a source coupled to the first reference voltage, and having a drain;

a second bipolar transistor having a collector coupled to the drain of the second MOS transistor, having a base, and having an emitter coupled to the second reference voltage; and a first resistor connected between the base of the second bipolar transistor and the second reference voltage, wherein the base of the first bipolar transistor is connected to the collector of the second bipolar transistor;

a current mirror third leg including:

a third MOS transistor, having a gate coupled to the gate and drain of the first MOS transistor, having a source coupled to the first reference voltage, and having a drain;

a third bipolar transistor, having a collector and a base connected together and coupled to the drain of the third MOS transistor, and having an emitter coupled to the second reference voltage; and a second resistor coupling the drain of the third MOS transistor to the collector of the third bipolar transistor, wherein the base of the second bipolar transistor is coupled to the collector and base of the third bipolar transistor via the second resistor; and a startup leg including:

a fourth bipolar transistor, having a collector coupled to the first reference voltage, having an emitter, and having a base coupled to the drain of the first MOS transistor; and a third resistor, coupling the emitter of the fourth bipolar transistor to the second reference voltage.

2. The circuit of claim 1, wherein the first resistor has a resistance that is a multiple of the resistance of the second resistor.

3. The circuit of claim 1, wherein the circuit further comprises an output MOS transistor, having a source-drain path, and having a gate connected to the gate and drain of the first MOS transistor.

4. The circuit of claim 3, wherein the output MOS transistor has a source coupled to the first reference voltage, and is for presenting an output reference current at its drain.

5. The circuit of claim 1, wherein the circuit further comprises a capacitor connected between the collector and base of the first bipolar transistor.

6. The circuit of claim 5, wherein the circuit further comprises a fourth resistor, coupled between the drain of the first MOS transistor and the collector of the first bipolar transistor.

7. The circuit of claim 1, wherein the third bipolar transistor has an emitter area that is N times the size of the emitter area of the second bipolar transistor.

8. The circuit of claim 1, wherein the first MOS transistor has a channel width-to-length ratio that is a first multiple of the channel width-to- length ratio of the second MOS transistor, and wherein the first bipolar transistor has an emitter area having a size that is the first multiple of the size of the emitter area of the second bipolar transistor.

9. The circuit of claim 8, wherein the first multiple is two.

10. A method of generating a reference current comprising:

defining a startup base current as a base current of a first bipolar transistor corresponding to the collector-emitter current conducted by a series connection of the first bipolar transistor and a first resistor, between first and second reference voltages;

drawing the startup base current through a diode-connected MOS transistor in a first leg of a current minor;

mirroring the current conducted by the diode-connected MOS transistor at a second leg of the current mirror, at a reference leg of the current mirror, and at an output transistor; and conducting current in the first leg of the current mirror so that the mirrored current in the reference leg is the sum of a positive temperature coefficient current and a negative temperature coefficient current by:

splitting current from a first node in the reference leg into a first branch in which current varies proportionally with absolute temperature, and into a second branch in which current varies inversely with absolute temperature;

conducting the mirrored current in the second leg of the current minor as collector-emitter current of a bipolar transistor in that second leg;

conducting the mirrored current in the reference leg of the current mirror as collector-emitter current of a bipolar transistor in the reference leg, the bipolar transistor in the reference leg having an emitter area of a size N times that of the emitter area of the bipolar transistor in the second leg, wherein the current conducted in the first leg of the current minor includes the startup base current and collector-emitter current conducted by a bipolar transistor in the first leg, and wherein the base of the bipolar transistor in the second leg of the current mirror is connected to the first node and to the first resistor, the first node also being connected to the collector and base of the bipolar transistor in the reference leg of the current minor through a second resistor and wherein the base of the bipolar transistor in the first leg of the current minor is connected to a second node in the second leg.

11. The method of claim 10, wherein the method further comprises controlling transient response by a capacitor connected between the base and the collector of the bipolar transistor in the first leg.

12. A method of generating a reference current comprising:

increasing a first reference voltage relative to a second reference voltage, wherein a first leg of a current mirror is connected between the first and second reference voltages, the first leg including the series connection of a first MOS transistor connected in diode fashion and a first bipolar transistor, wherein the step of increasing the first reference voltage injects base current into a startup bipolar transistor having its collector-emitter path connected in series with a first resistor between the first and second reference voltages, wherein the base of the first bipolar transistor is connected to the collector of a second bipolar transistor in a second leg of the current mirror, the second leg also including a second MOS transistor having a source-drain path connected in series with the collector-emitter path of the second bipolar transistor between the first and second reference voltages, and having a gate connected to the gate of the first MOS transistor;

minoring the injected base current conducted by the first MOS transistor into the second leg and a third leg of the current mirror, the third leg of the current mirror including a third MOS transistor having a gate connected to the gate of the first MOS transistor, and a third bipolar transistor having its collector and base connected together, and having a collector-emitter path connected in series with the source-drain path of the third MOS transistor; and drawing the reference current from the source-drain path of a fourth MOS transistor having its source-drain path connected to the first reference voltage and its gate connected to the gate of the first MOS transistor.

13. The method of claim 12, wherein the method further comprises splitting current conducted in the third leg of the current minor into a first branch comprising a second resistor connected between the base of the second bipolar transistor and the second reference voltage, and into a second branch comprising a third resistor in series with the collector-emitter path of the third bipolar transistor, wherein the third bipolar transistor has an emitter area of a size that is a multiple of the emitter area of the second bipolar transistor.

14. The method of claim 12, wherein the method further comprises controlling transient response to startup using a capacitor connected between the collector and base of the first bipolar transistor.

15. The method of claim 14, wherein the method further comprises controlling transient response to variations in the first reference voltage relative to the second reference voltage using a fourth resistor connected in series between the source-drain path of the first MOS transistor and the collector of the first bipolar transistor, wherein the capacitor is connected to the first leg of the current minor at a node between the third resistor and the collector of the first bipolar transistor.

16. The method of claim 12, wherein the first MOS transistor has a channel width-to-length ratio that is a first multiple of the channel width-to-length ratio of the second MOS transistor, and wherein the first bipolar transistor has an emitter area of a size that is the first multiple of the size of the emitter area of the second bipolar transistor.

17. The method of claim 16, wherein the first multiple is two.

* * * * *